US008266877B2

(12) United States Patent
Biondi et al.

(10) Patent No.: US 8,266,877 B2
(45) Date of Patent: Sep. 18, 2012

(54) PACKING METHOD AND UNIT FOR FOLDING A SHEET OF PACKING MATERIAL ABOUT A PARALLELEPIPED-SHAPED ARTICLE

(75) Inventors: Andrea Biondi, Bologna (IT); Michele Squarzoni, Ferrara (IT); Paolo Degliesposti, Bologna (IT); Maurizio Ventura, Crespellano (IT)

(73) Assignee: G.D Societa' per Azioni, Bologna (IT)

( * ) Notice: Subject to any disclaimer, the term of this patent is extended or adjusted under 35 U.S.C. 154(b) by 352 days.

(21) Appl. No.: 12/628,644

(22) Filed: Dec. 1, 2009

(65) Prior Publication Data

US 2010/0132312 A1 Jun. 3, 2010

(30) Foreign Application Priority Data

Dec. 2, 2008 (IT) ..... BO2008A0727
Jun. 10, 2009 (IT) ..... BO2009A0377

(51) Int. Cl.
*B65B 11/00* (2006.01)

(52) U.S. Cl. ..... 53/466; 53/586; 53/210; 53/228

(58) Field of Classification Search ..... 53/466, 53/586, 210, 220–225, 228, 230, 232–234
See application file for complete search history.

(56) References Cited

U.S. PATENT DOCUMENTS

| | | | | |
|---|---|---|---|---|
| 1,458,977 | A * | 6/1923 | De Escobales | 229/87.13 |
| 2,860,466 | A * | 11/1958 | Ingram | 53/223 |
| 4,241,564 | A * | 12/1980 | Quarenghi | 53/575 |
| 4,711,065 | A * | 12/1987 | Focke et al. | 53/170 |
| 5,081,821 | A * | 1/1992 | Meives | 53/466 |
| 6,658,819 | B2 * | 12/2003 | Gamberini | 53/436 |
| 6,796,103 | B2 * | 9/2004 | Gamberini | 53/228 |
| 6,854,243 | B2 * | 2/2005 | Sendo et al. | 53/234 |
| 8,015,781 | B2 * | 9/2011 | Kent | 53/536 |
| 2002/0050118 | A1 | 5/2002 | Focke et al. | |
| 2002/0073649 | A1 * | 6/2002 | Gamberini | 53/228 |
| 2002/0189207 | A1 | 12/2002 | Spatafora et al. | |
| 2005/0097865 | A1 * | 5/2005 | Gamberini | 53/466 |
| 2005/0166550 | A1 * | 8/2005 | Biondi et al. | 53/415 |

FOREIGN PATENT DOCUMENTS

| | | |
|---|---|---|
| DE | 10 24 869 | 2/1958 |
| EP | 1 116 660 | 7/2001 |
| EP | 1 260 442 | 11/2002 |

OTHER PUBLICATIONS

European Search Report in corresponding European Application No. 09177542.9 dated Mar. 29, 2010.

* cited by examiner

*Primary Examiner* — Hemant M Desai
(74) *Attorney, Agent, or Firm* — Marshall, Gerstein & Borun LLP

(57) ABSTRACT

A packing method and unit for folding a sheet of packing material about a parallelepiped-shaped article, the packing unit having: a conveyor for feeding the article along a path; a feed device for feeding the sheet of packing material perpendicularly to the path and in front of the article, so the article, as it moves forward, intercepts and gradually folds the sheet of packing material into a "U"; two lead-in devices mounted to move parallel to the path and positioned on opposite sides of the article, so the article is enclosed between the two lead-in devices; and an actuating device for feeding the two lead-in devices parallel to the path and together with the article, so the sheet of packing material is also intercepted by the lead-in devices.

18 Claims, 12 Drawing Sheets

PACKING METHOD AND UNIT FOR FOLDING A SHEET OF PACKING MATERIAL ABOUT A PARALLELEPIPED-SHAPED ARTICLE

CROSS-REFERENCE TO RELATED APPLICATIONS

This application claims the benefit of Italian patent application No. BO 2008A 000727, filed Dec. 2, 2008 and Italian patent application No. BO 2009A 000377, filed Jun. 10, 2009.

TECHNICAL FIELD

The present invention relates to a packing method and unit for folding a sheet of packing material about a parallelepiped-shaped article.

The present invention may be used to advantage for folding a sheet of packing material about a group of cigarettes, to which the following description refers purely by way of example.

BACKGROUND ART

A packet of cigarettes normally comprises an inner package defined by a group of cigarettes wrapped in a sheet of inner packing material (normally foil with no glue); and an outer package enclosing the inner package, and which is stabilized using glue, and may be defined by a sheet of outer packing material folded into a cup shape about the inner package (soft packet of cigarettes), or by a rigid, hinged-lid box formed by folding a rigid blank about the inner package (rigid packet of cigarettes).

On almost all currently marketed packing machines, folding a sheet of packing material about a group of cigarettes commences with folding the sheet of packing material into a U about the group of cigarettes. This is normally done by feeding the group of cigarettes along a straight path, and feeding the sheet of packing material perpendicularly across the path, ahead of the group of cigarettes, so the group of cigarettes, as it moves forward, intercepts and gradually folds the sheet of packing material into a U.

It has been observed that folding the sheet of packing material into a U about the group of cigarettes as described above may damage the ends of the cigarettes, thus resulting in localized deformation (of both the filter ends and the plain ends where the tobacco is exposed), and/or in tobacco spill (i.e. tobacco fallout, obviously only from the plain ends where the tobacco is exposed). This applies in particular to the corner cigarettes in the group, though damage is evident to some extent in all the outermost cigarettes, i.e. located along the fold lines of the sheet of packing material. Moreover, the above method of folding the sheet of packing material into a U about the group of cigarettes fails to provide for forming square edges, on account of the stiffness of the sheet of packing material deforming the cigarettes and so resulting in the formation of rounded edges. The fact that the package is rounded as opposed to square is particularly undesirable, by producing an overall look of the package that is not very popular with consumers, who tend to opt for packages with decidedly sharp edges.

DISCLOSURE OF THE INVENTION

It is an object of the present invention to provide a packing method and unit for folding a sheet of packing material about a parallelepiped-shaped article, which packing method and unit are cheap and easy to implement, and designed to eliminate the aforementioned drawbacks.

According to the present invention, there are provided a packing method and unit for folding a sheet of packing material about a parallelepiped-shaped article, as claimed in the attached claims.

BRIEF DESCRIPTION OF THE DRAWINGS

A non-limiting embodiment of the present invent w ion will be described by way of example with reference to the accompanying drawings, in which.

PREFERRED EMBODIMENTS OF THE INVENTION

Figure 1:
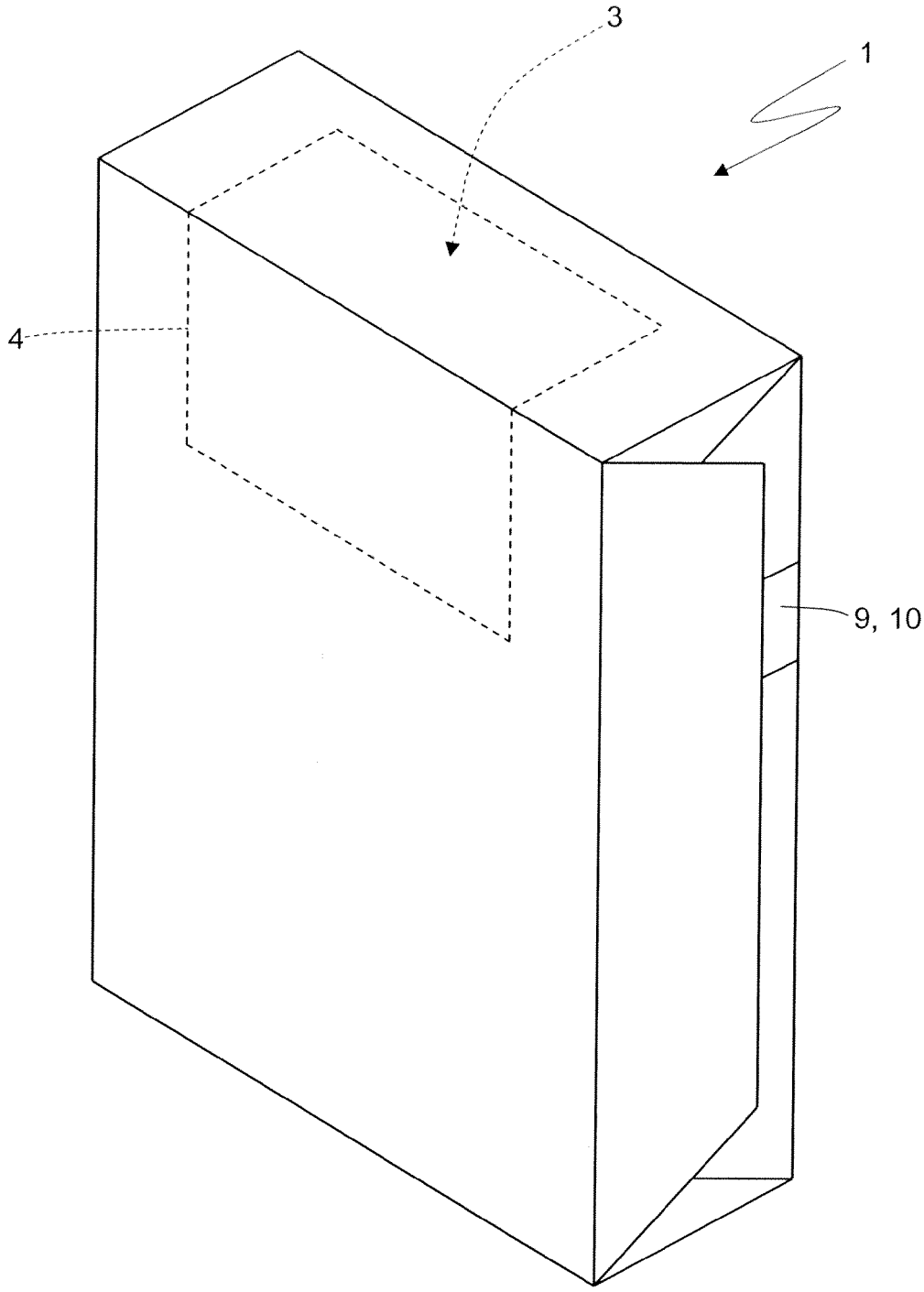
FIG. 1 shows a front view in perspective of a package of cigarettes produced using the packing method according to the present invention.
Figure 2:
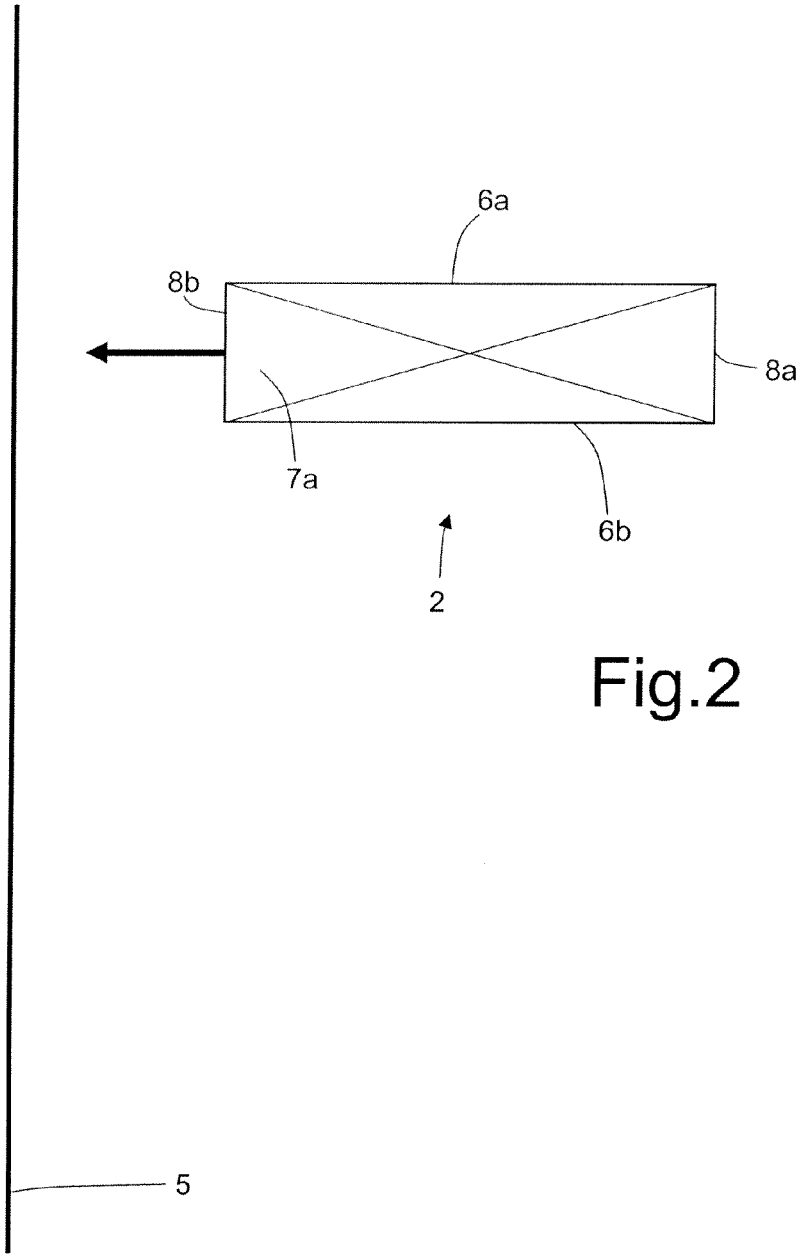
FIGS. 2-6 show a number of steps in the packing method according to the present invention, to fold a sheet of packing material about a group of cigarettes to obtain the FIG. 1 package of cigarettes.

Number 1 in FIG. 1 indicates as a whole a package of cigarettes, e.g. of the type described in U.S. Pat. No. 4,300,676A1. Package 1 of cigarettes encloses a parallelepiped-shaped group 2 of cigarettes (shown schematically in FIGS. 2-6), and has a cigarette extraction opening 3, at the top and front, bounded by a tear line 4 and covering a portion of a front wall of package 1, and a portion of a top wall of package 1. To unseal package 1, the user tears the package along tear line 4 to eliminate the package at extraction opening 3 and so access the cigarettes in group 2 through extraction opening 3.

As described in U.S. Pat. No. 4,300,676A1, package 1 of cigarettes as described above may be inserted inside a known rigid, hinged-lid cigarette packet, and extraction opening 3 may be closed by a reclosable cover flap fixed to package 1 by non-dry, non-setting adhesive.

Package 1 is formed by folding a rectangular sheet 5 (shown schematically in FIGS. 2-6) of airtight, heat-seal plastic packing material (or multilayer composite material having at least one layer of plastic material) directly about group 2 of cigarettes and in direct contact with the cigarettes. Once sheet 5 of packing material is folded about group 2 of cigarettes to form package 1, the shape of package 1 is stabilized by heat sealing the superimposed portions of sheet 5 of packing material.

Before being folded about group 2 of cigarettes, sheet 5 of packing material is cut to define extraction opening 3, and may then be fixed with the cover flap gummed on the underside, i.e. coated on the underside with non-setting adhesive, which, inside extraction opening 3, glues the inner portion of sheet 5 of packing material permanently to the cover flap, and, outside extraction opening 3, glues sheet 5 of packing material releasably to the cover flap.

In a further embodiment, not shown, package 1 comprises a U-shaped stiffener of rigid cardboard, which is inserted inside package 1, contacting group 2 of cigarettes. The stiffener comprises a rectangular central panel positioned contacting a bottom wall of group 2 defined by the tips of the cigarettes (or contacting a front wall of group 2 defined by the cylindrical lateral walls of the cigarettes); and two lateral wings connected to the central panel along two fold lines, and positioned contacting the minor lateral walls of group 2 defined by the cylindrical lateral walls of the cigarettes.

FIGS. 2-6 show the steps in folding sheet 5 of packing material about group 2 of cigarettes, which comprises two opposite, parallel major lateral walls 6*a* and 6*b* defined by the cylindrical lateral walls of the cigarettes; two opposite, parallel minor lateral walls 7*a* and 7*b* (only one shown) defined by the cylindrical lateral walls of the cigarettes; and two opposite end walls 8*a* and 8*b* defined by the tips of the cigarettes.

Figure 3:
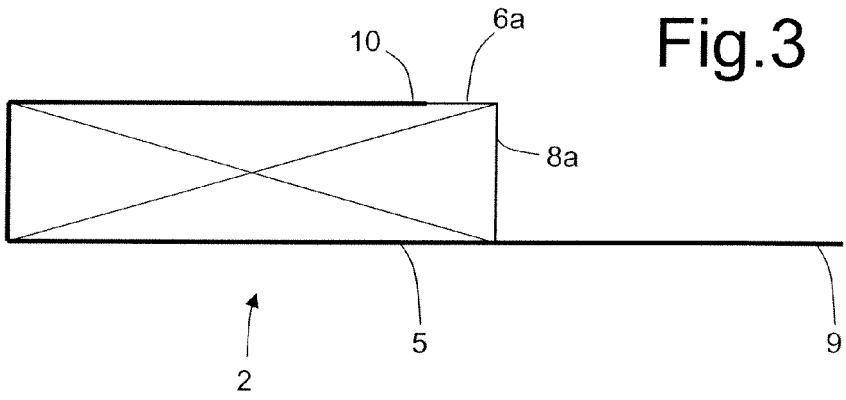
Figure 4:
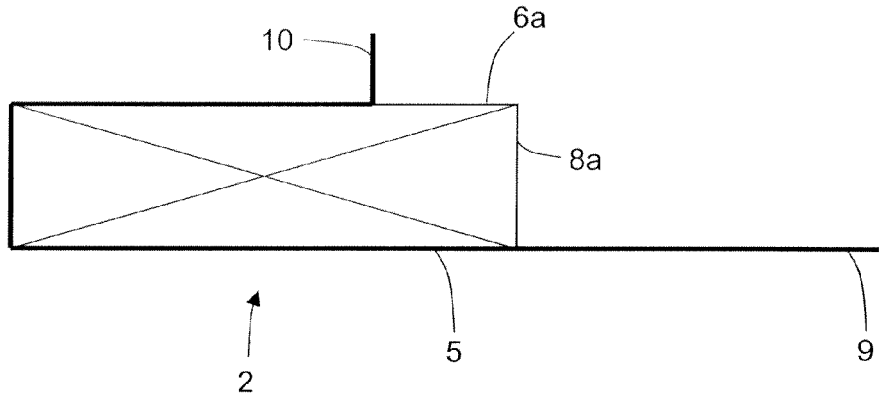
Figure 5:
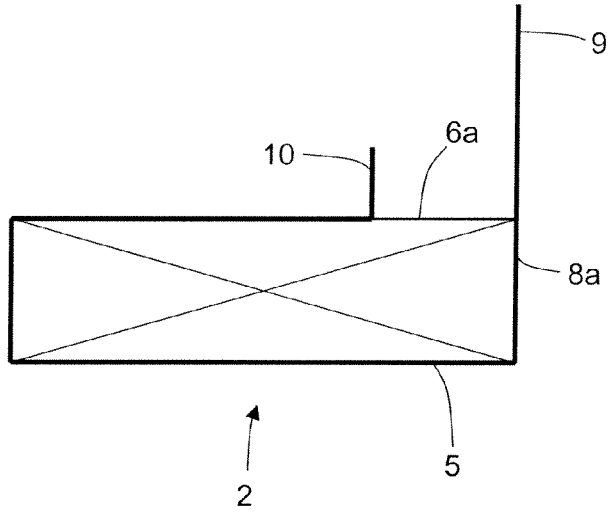
Figure 6:
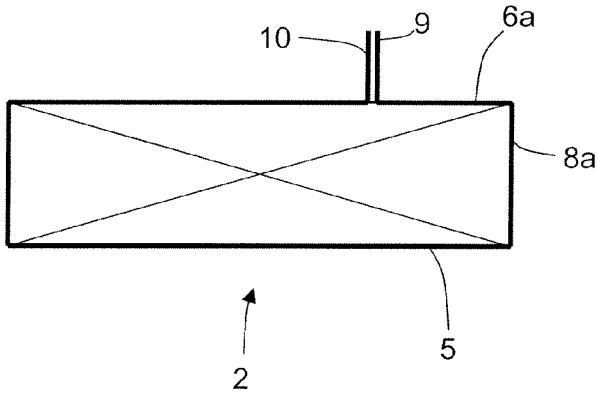

Firstly, group 2 of cigarettes and the flat sheet 5 of packing material are combined by bringing end wall 8*b* of group 2 into contact with sheet 5 of packing material (FIG. 2), so the sheet of packing material folds into a U about group 2 (FIG. 3). That is, the leading end wall 8*b* of group 2 impacts sheet 5 of packing material, which gradually folds into a U onto the two major lateral walls 6. It is important to note that sheet 5 of packing material is fed asymmetrically past group 2 to define two differently arranged flaps 9 and 10 of different lengths. As shown in FIG. 3, the sheet 5 of packing material folded into a U about group 2 has an outer flap 9 projecting from group 2, and an inner flap 10 resting on lateral wall 6*a* of group 2. As shown in FIG. 4, inner flap 10 is folded perpendicularly to lateral wall 6*a* of group 2. As shown in FIG. 5, outer flap 9 is folded 90° onto end wall 8*a* of group 2. As shown in FIG. 6, outer flap 9 is folded into an L onto lateral wall 6*a* of group 2 and against inner flap 10 perpendicular to lateral wall 6*a*, so as to superimpose outer flap 9 and inner flap 10 and form sheet 5 of packing material into a tube. The superimposed portions of outer flap 9 and inner flap 10 are heat sealed to stabilize the tubular shape of sheet 5 of packing material; and, finally, the heat-sealed superimposed flaps 9 and 10 are folded 90° onto lateral wall 6*a* of group 2 (as shown partly in FIG. 1).

Figure 7:
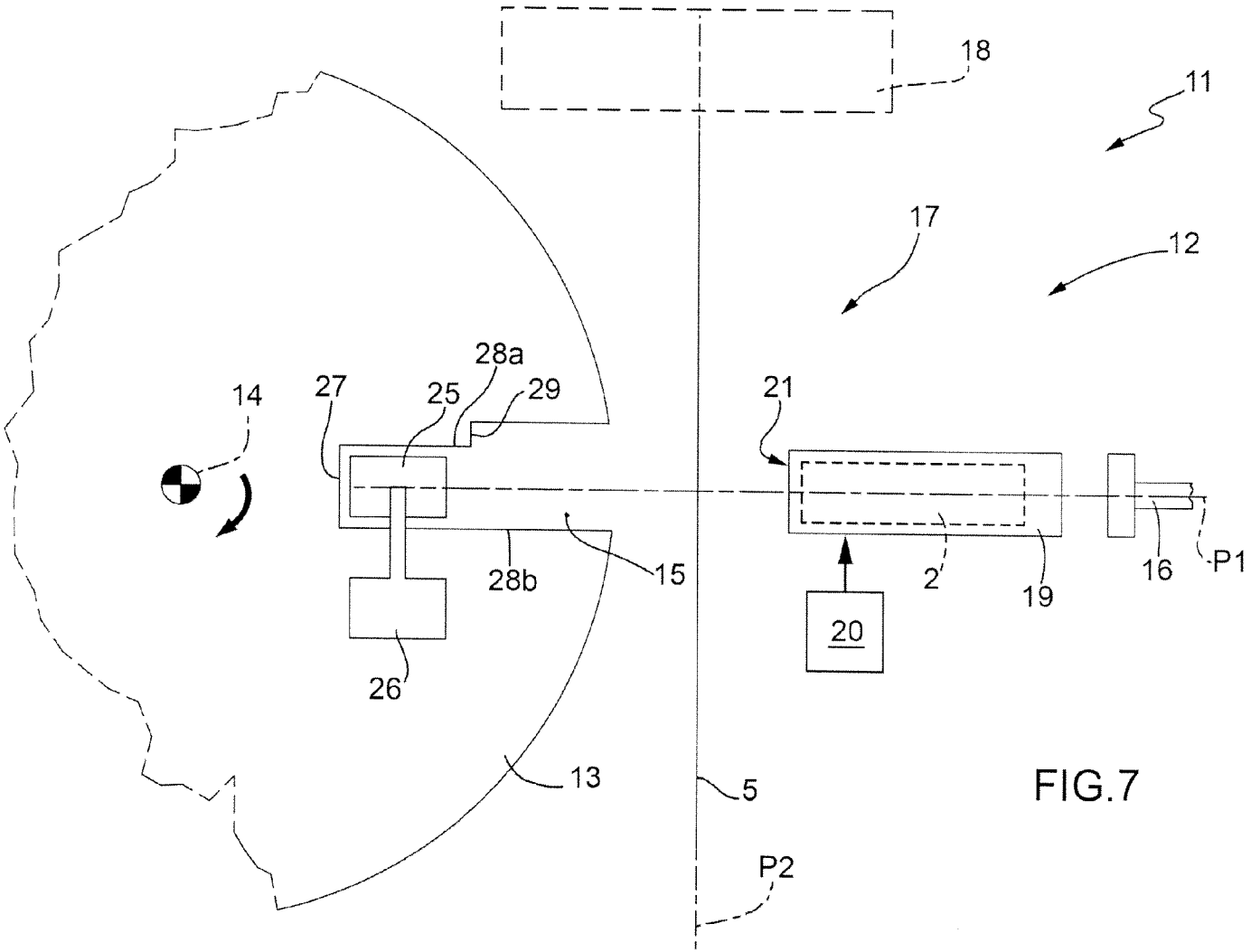
FIG. 7 shows a schematic side view, with parts removed for clarity, of a cigarette packing machine packing unit for producing the FIG. 1 package of cigarettes and in accordance with the present invention.

Number 11 in FIG. 7 indicates as a whole a packing machine for producing the FIG. 1 package 1 of cigarettes as shown in FIGS. 2-6.

Packing machine 11 comprises a group-forming unit (not shown in FIG. 7) for successively forming groups 2 of cigarettes; and a packing unit 12 (shown in FIG. 7) for wrapping and heat sealing a respective sheet 5 of packing material about each group 2 of cigarettes. It is important to note that packing machine 11 may comprise only the group-forming unit (not shown in FIG. 7) and packing unit 12; in which case, each package 1 as described above is a finished marketable product. Alternatively, packing machine 11 may also comprise a further known packing station for packing each package 1 in a respective outer package, which encloses package 1 and may be defined by a sheet of outer packing material folded into a cup shape about package 1 (soft packet of cigarettes), or by a rigid, hinged-lid box formed by folding a rigid blank about package 1 (rigid packet of cigarettes).

Packing unit 12 in FIG. 7 comprises a packing wheel 13, which receives groups 2 of cigarettes from the group-forming unit (not shown), rotates in steps (clockwise in FIG. 7) about a horizontal axis of rotation 14 perpendicular to the FIG. 7 plane, and supports a number of peripheral pockets 15, each for housing a group 2 of cigarettes.

Packing unit 12 also comprises a feed conveyor 16 (shown schematically in the form of a pusher) for feeding a group 2 of cigarettes along a straight path P1, which extends through a feed station 17, terminates at packing wheel 13, and is perpendicular to axis of rotation 14. At feed station 17, a feed device 18 feeds sheet 5 of packing material along a path P2 perpendicular to and intersecting path P1 of group 2, so sheet 5 of packing material is fed, perpendicularly to path P1, past the moving group 2, which intercepts and gradually folds sheet 5 of packing material into a U.

Packing unit 12 comprises two lead-in devices 19 (only one shown in FIG. 7) movable parallel to path P1 and located on opposite sides of, to enclose, group 2 of cigarettes. More specifically, the two lead-in devices 19 are positioned contacting the minor lateral walls 7 of group 2. Packing unit 12 also comprises an actuating device 20 for feeding the two lead-in devices 19 parallel to path P1 together with group 2 of cigarettes, so sheet 5 of packing material is also intercepted by lead-in devices 19. In other words, the two lead-in devices 19 are movable, parallel to path P1, between a start position (FIG. 8), in which the two lead-in devices 19 enclose group 2 upstream from sheet 5 of packing material (i.e. before group 2 intercepts sheet 5 of packing material), and an end position (shown substantially in FIG. 10), in which the two lead-in devices 19 enclose group 2 downstream from sheet 5 of packing material (i.e. after group 2 intercepts sheet 5 of packing material) and inside pocket 15 of packing wheel 13.

Figure 11:
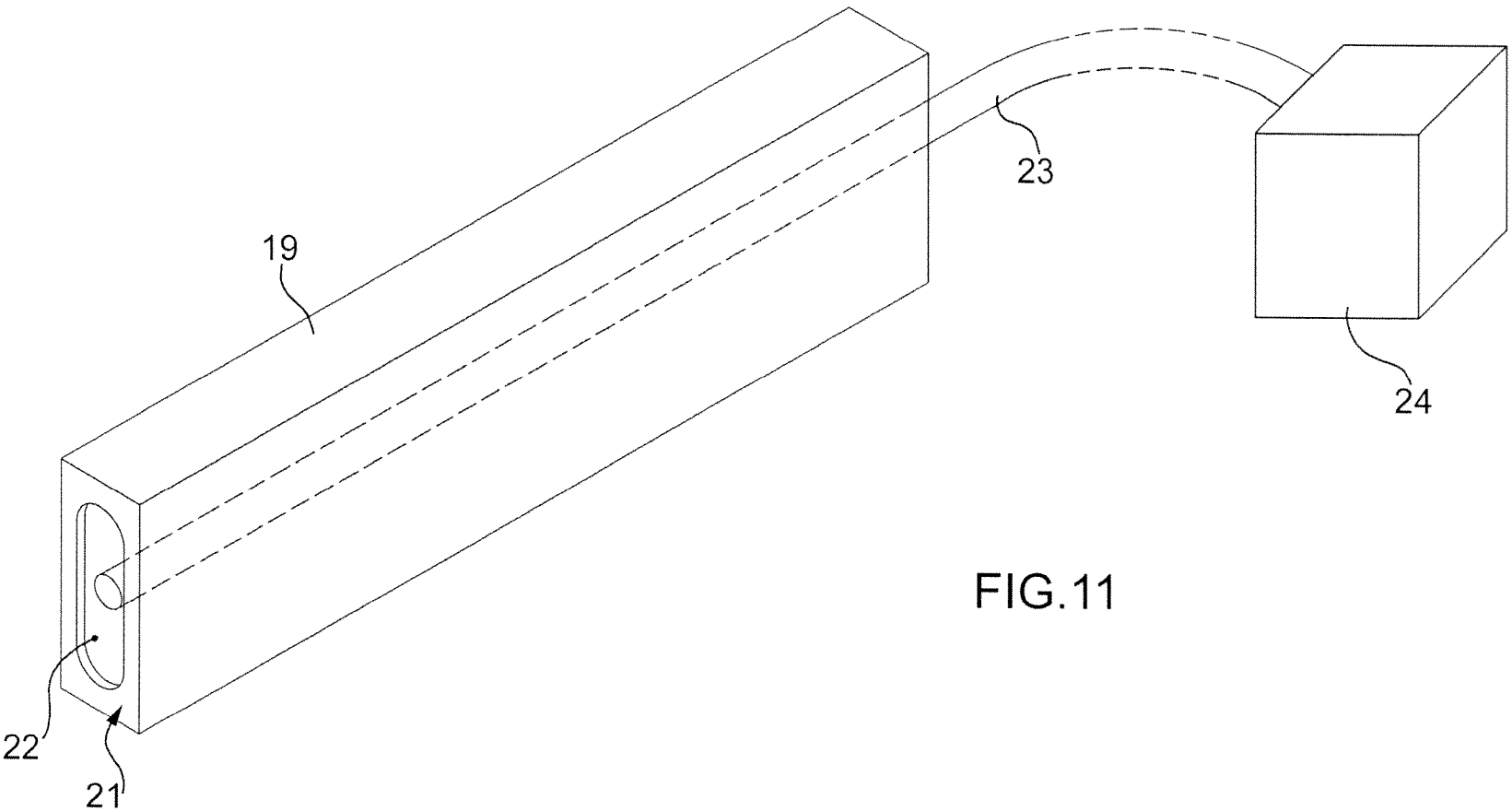
FIG. 11 shows a schematic view in perspective, with parts removed for clarity, of a lead-in device of the FIG. 7 packing unit.

As shown in FIG. 11, each lead-in device 19 comprises a front wall 21 facing sheet 5 of packing material and having a suction seat 22, through which suction is activated along a channel 23 connecting suction seat 22 to a suction source 24. Each channel 23 extends partly inside lead-in device 19, and is regulated by a valve (not shown) for activating/deactivating suction through suction seat 22.

Figure 10:
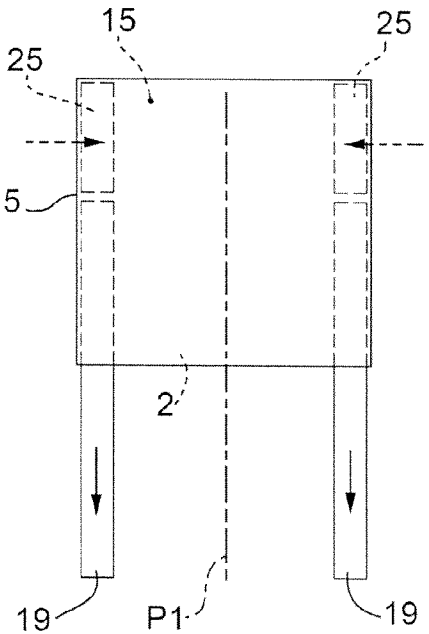
FIGS. 8, 9 and 10 show schematic plan views, with parts removed for clarity, of the FIG. 7 packing unit folding a sheet of packing material about a group of cigarettes.

As shown in FIGS. 7-10, pocket 15 of packing wheel 13 comprises two lateral retainers 25 for gripping group 2 of cigarettes laterally and preventing lateral movement of group 2 inside pocket 15. In the preferred embodiment in FIGS. 7-10, the two lateral retainers 25 are mounted to move, crosswise to pocket 15, between a closed position (FIG. 10), in which lateral retainers 25 grip group 2 laterally inside pocket 15 and are therefore positioned contacting minor lateral walls 7 of group 2, and an open position (FIGS. 8 and 9), in which lateral retainers 25 are detached from group 2 inside pocket 15. More specifically, a cam actuating device 26 is connected mechanically to lateral retainers 25 to move them between the above closed and open positions. In a different embodiment, lateral retainers 25 are fixed and remain permanently in the closed position (FIG. 10).

Operation of packing unit 12 will now be described with reference to FIGS. 8, 9 and 10, which show the folding sequence of sheet 5 of packing material into a U about group 2 of cigarettes.

Firstly (FIG. 8), as it travels along path P1, group 2 of cigarettes passes between the two stationary lead-in devices 19 waiting for group 2 upstream from feed station 17 (i.e. upstream from sheet 5 of packing material). Once group 2 is positioned between them, the two lead-in devices 19 are moved parallel to path P1, together with group 2, to accompany group 2 through feed station 17 and against sheet 5 of packing material. That is, the two lead-in devices 19 are located on opposite sides of, to enclose, group 2 of cigarettes, and are moved parallel to path P1, together with group 2, so that sheet 5 of packing material is also intercepted by lead-in devices 19.

In a preferred embodiment, lead-in devices 19 are moved forward with the same law of motion (i.e. the same instantaneous speed) as group 2 at the time of impact with sheet 5 of packing material, so that, when lead-in devices 19 and group 2 impact sheet 5 of packing material, lead-in devices 19 and group 2 have and maintain exactly the same instantaneous speed, with no relative movement between them. Lead-in devices 19 are preferably moved forward in line with the end wall 8*b* of group 2 facing sheet 5 of packing material at the time of impact with sheet 5 of packing material. That is, at the time of impact with sheet 5 of packing material, front walls 21 of lead-in devices 19 are aligned, along path P1, with end wall 8*b* of group 2, so sheet 5 of packing material is intercepted simultaneously by group 2 and lead-in devices 19. In a different embodiment not shown, lead-in devices 19 are moved forward slightly ahead of end wall 8*b* of group 2 at the time of impact with sheet 5 of packing material, which is therefore only intercepted initially by lead-in devices 19.

In a preferred embodiment, prior to impacting sheet 5 of packing material, suction is activated through front walls 21 of lead-in devices 19 facing sheet 5 of packing material, so sheet 5 of packing material is retained by suction on front walls 21 of lead-in devices 19 to prevent it from slipping as it is folded. Suction through front walls 21 of lead-in devices 19 facing sheet 5 of packing material is cut off just before lead-in devices 19 begin reversing in the opposite direction to the travelling direction of group 2 (FIG. 10).

Figure 9:
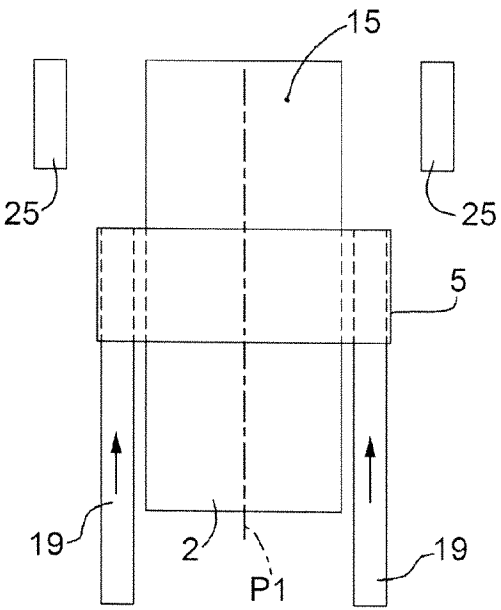
Figure 8:
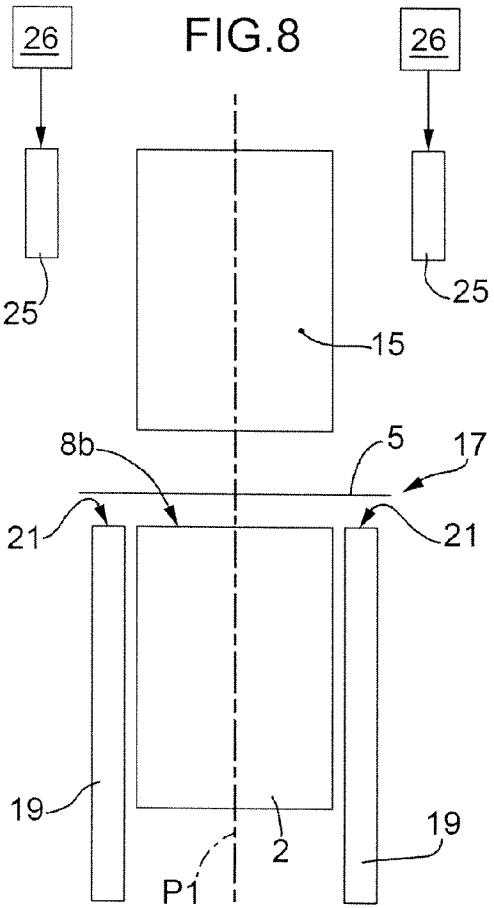

As shown in FIGS. 8, 9 and 10, downstream from feed station 17 and at the end of path P1, group 2 and sheet 5 of packing material, folded into a U about group 2, are inserted inside pocket 15. Reversing of lead-in devices 19, in the opposite direction to the travelling direction of group 2, commences when group 2 is at least partly inserted inside pocket 15, as shown in FIG. 10. In a preferred embodiment, reversing of lead-in devices 19 commences when group 2 is fully inserted or only partly inserted inside pocket 15. In a further embodiment, not shown, reversing of lead-in devices 19 commences before group 2 is inserted inside pocket 15.

As shown in FIGS. 8 and 9, lateral retainers 25 are set to the open position as group 2 is inserted inside pocket 15, to prevent sheet 5 of packing material from contacting and being folded by lateral retainers 25. Once group 2 is inserted inside pocket 15, lateral retainers 25 are moved into the closed position, as shown in FIG. 10, to retain group 2 laterally without interfering in any way with (i.e. without folding) sheet 5 of packing material. To maintain lateral support at all times of group 2 (which is unstable in shape, by simply comprising a number of superimposed layers of cigarettes), lateral retainers 25, as shown in FIG. 10, are shorter than group 2, and are moved into the closed position when group 2 is still partly enclosed by lead-in devices 19, so that, at least for an instant, group 2 is confined laterally by both lateral retainers 25 and lead-in devices 19.

In the embodiment in which lateral retainers 25 are fixed permanently in the closed position (FIG. 10), the lateral portions of sheet 5 of packing material projecting outwards of group 2 are folded, on impacting lateral retainers 25, onto the minor lateral walls 7 of group 2.

Packing unit 12 described above has numerous advantages. In particular, it is cheap and easy to produce, by involving only minor alterations to a similar known packing unit.

Moreover, on packing unit 12, sheet 5 of packing material is not only folded by contact with group 2 of cigarettes, but also, and above all, by contact with lead-in devices 19 on either side of group 2, so the pressure exerted by sheet 5 of packing material, as it is being folded, is also distributed over lead-in devices 19, as opposed to solely on group 2. Particularly important to note is that, lead-in devices 19 being initially aligned with end wall 8*b* of group 2, even the slightest amount of deformation (invisible to the naked eye) of leading end wall 8 of group 2 is sufficient to transfer most of the pressure exerted by sheet 5 of packing material to lead-in devices 19, which, being made of steel (or other equivalent rigid material) are practically undeformable. Group 2 is thus completely protected against severe mechanical stress during the initial folding of sheet 5 of packing material, and the tips of the cigarettes undergo no deformation.

Lastly, by virtue of lead-in devices 19, the edges of sheet 5 of packing material at end wall 8*b* of group 2 are sharp and well defined, to impart an attractive square shape to this part of sheet 5.

Each pocket 15 has a U-shaped longitudinal section, and comprises an end wall 27 contacting end wall 8*b* of group 2 with the interposition of sheet 5 of packing material; and two opposite, parallel lateral walls 28 contacting major lateral walls 6 of group 2 with the interposition of sheet 5 of packing material. One lateral wall 28*a* of each pocket 15, contacting lateral wall 6*a* of group 2 with the interposition of sheet 5 of packing material, is shorter than the opposite lateral wall 28*b*, so as to leave inner flap 10 of sheet 5 of packing material exposed. Lateral wall 28*a* of each pocket 15 terminates with a transverse suction support 29 perpendicular to lateral wall 28*a*, and for retaining inner flap 10 of sheet 5 of packing material by suction. More specifically, a conduit, connectable to a suction source, comes out at transverse support 29.

At feed station 17, once sheet 5 of packing material has been folded into a U about group 2, inner flap 10 of sheet 5 of packing material is folded perpendicularly to lateral wall 6*a* of group 2, and rests against and is retained by suction in this position by transverse support 29. In other words, folding inner flap 10 perpendicularly to lateral wall 6*a* of group 2 also comprises drawing inner flap 10 by suction onto transverse suction support 29 of pocket 15. It is important to note that inner flap 10 may be folded perpendicularly to lateral wall 6*a* of group 2 either solely by suction by transverse support 29, or by the combined action of suction by transverse support 29 and a movable folding member (described in detail below).

Figure 12:
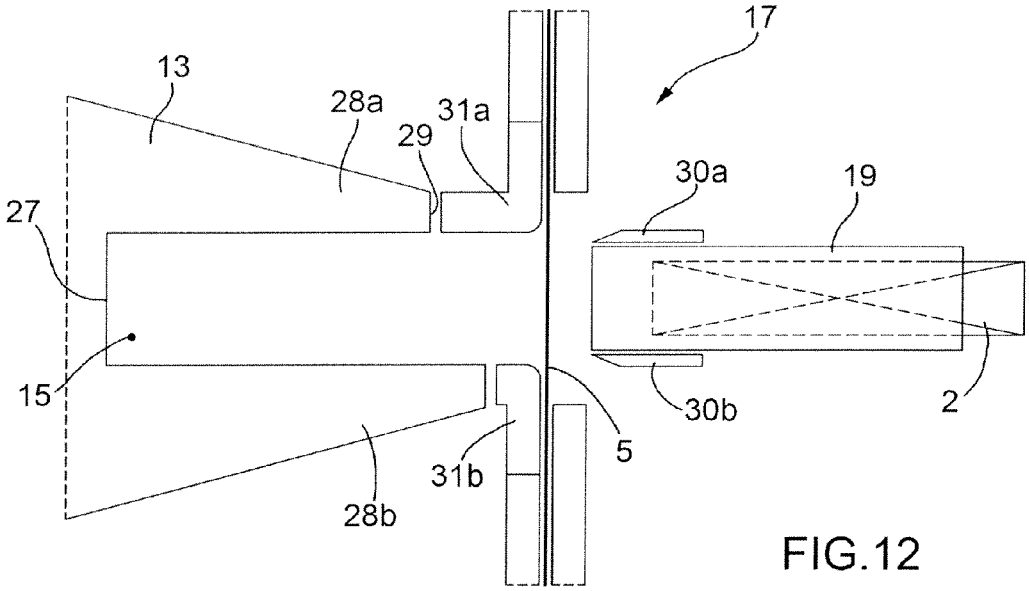
FIG. 12 shows a schematic side view, with parts removed for clarity, of a different embodiment of a feed station of the FIG. 7 packing unit.

In a different embodiment shown in FIG. 12, packing unit 12 also comprises two folding members 30 located on opposite sides of path P1 and spaced apart to let through group 2 together with lead-in devices 19. More specifically, folding members 30 are positioned parallel to and facing major lateral walls 6 of group 2, are thin, and each cooperate with a respective fixed contrasting member 31 located ahead of folding member 30, on the opposite side of path P2 of sheet 5 of packing material, i.e. sheet 5 of packing material is located between folding members 30 and respective contrasting members 31. Preferably, each folding member 30 is wedge-shaped at the front, and each contrasting member 31 is funnel-shaped to negatively reproduce the wedge shape of respective folding member 30.

Figure 13:
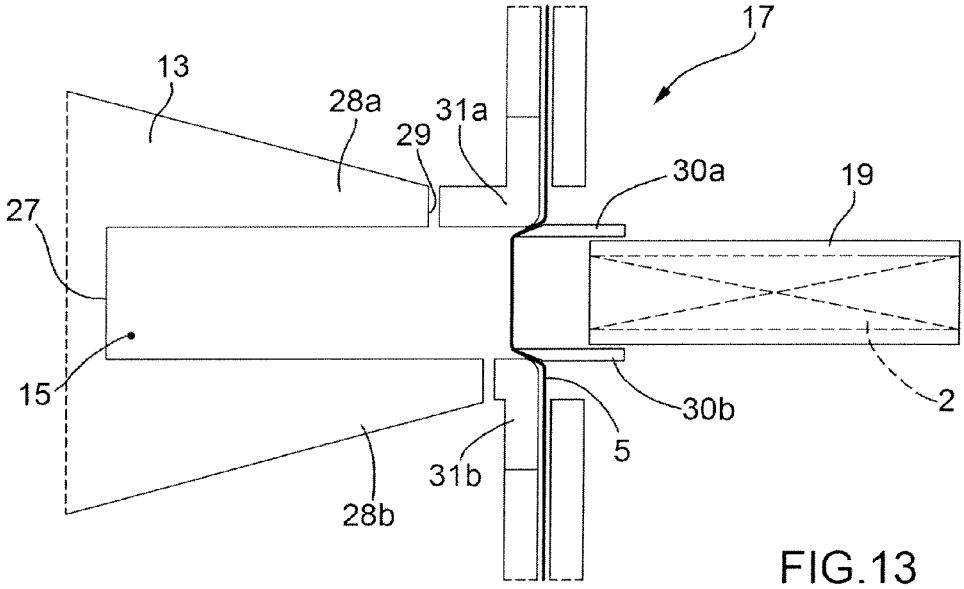
FIGS. 13-17 show schematic side views, with parts removed for clarity, of the FIG. 12 feed station folding a sheet of packing material about a group of cigarettes.
Figure 14:
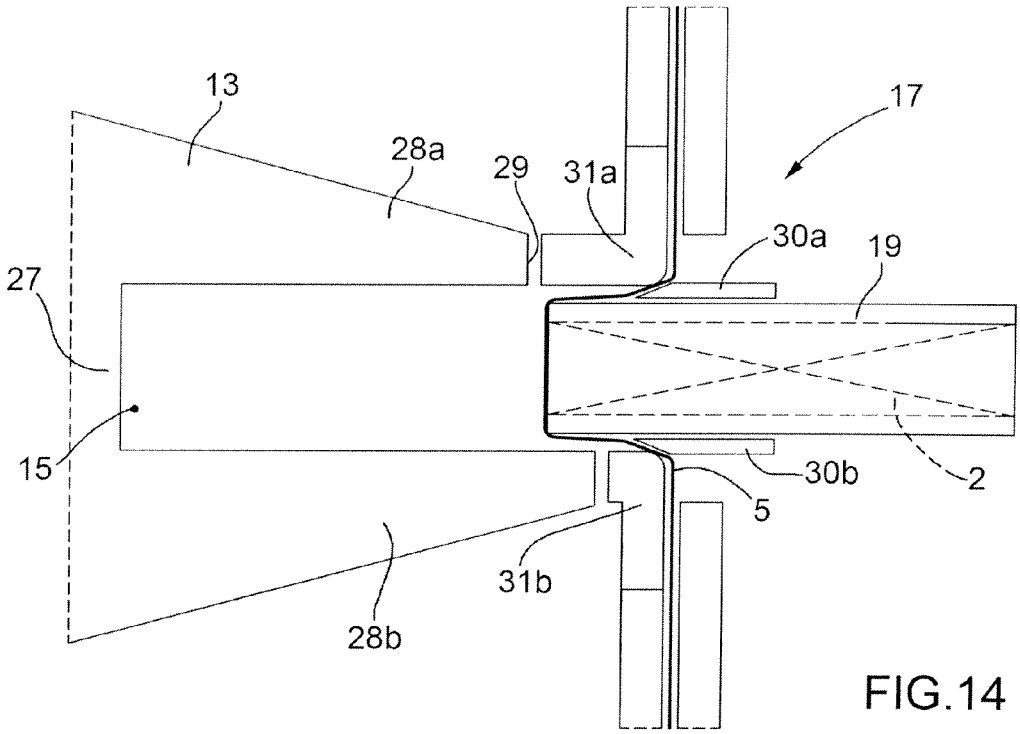

Packing unit 12 also comprises an actuating device for feeding the two folding members 30 parallel to path P1 ahead of group 2, on that sheet 5 of packing material is intercepted and folded partly into a U by folding members 30 (or rather, by folding members 30 inserted between contrasting members 31) before being intercepted by group 2 and the two lead-in devices 19 (FIG. 13). Group 2 and the two lead-in devices 19 then move through the two folding members 30 to intercept the already partly U-folded sheet 5 of packing material (FIG. 14). In other words, the two folding members 30 move together, parallel to path P1, between a start position (FIG. 12), in which the two folding members 30 are located upstream from path P2 of sheet 5 of packing material (i.e. upstream from sheet 5 of packing material), and a first folding position (FIG. 13), in which the two folding members 30 are inserted between contrasting members 31 (i.e. downstream from path P2 of sheet 5 of packing material) and have partly folded sheet 5 of packing material into a U.

Figure 15:
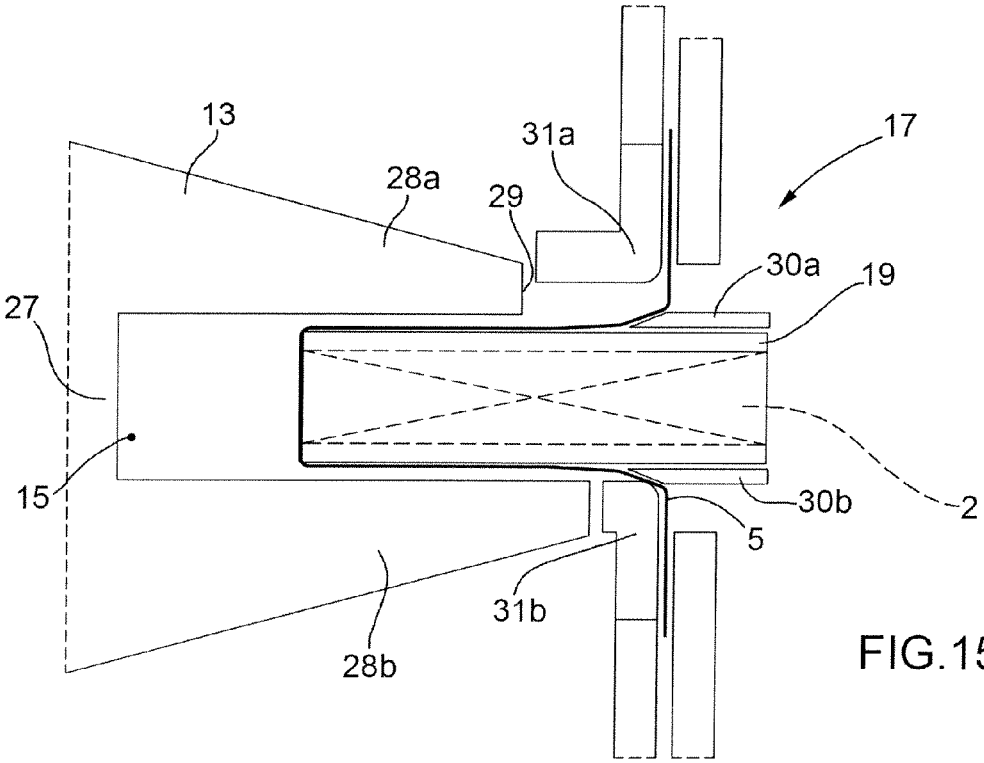
Figure 16:
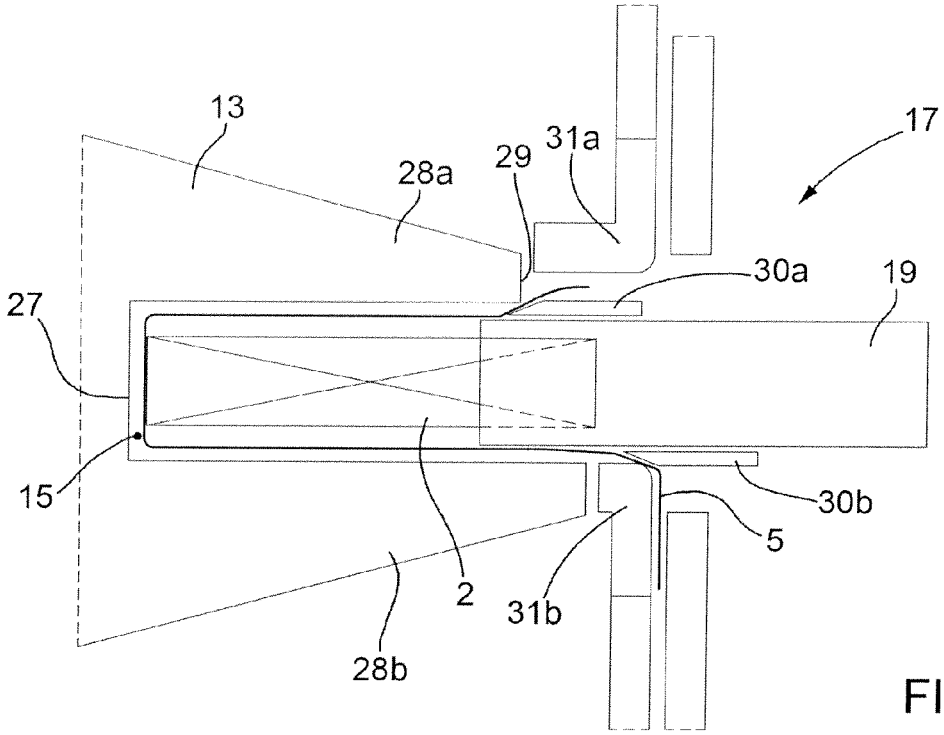

In a preferred embodiment, when folding members 30 are in the first folding position (FIG. 13) and group 2, together with sheet 5 of packing material, is fully or almost fully inserted between the two folding members 30, one contrasting member 31*a* is moved perpendicularly to path P1 to allow the corresponding folding member 30*a* to keep moving, parallel to path P1, substantially into contact with transverse support 29, so as to fold inner flap 10 perpendicularly to lateral wall 6*a* of group 2 (as shown in FIGS. 15 and 16). As stated, inner flap 10 is folded perpendicularly to lateral wall 6*a* of group 2 by the combined action of suction by transverse support 29 and movable folding member 30*a*.

Operation of packing unit 12 will now be described with reference to FIGS. 12-17 showing the folding sequence of sheet 5 of packing material into a U about group 2 of cigarettes.

Firstly (FIG. 12), as it travels along path P1, group 2 of cigarettes passes between the two stationary lead-in devices 19 waiting for group 2 upstream from feed station 17 (i.e. upstream from sheet 5 of packing material).

As shown in FIG. 13, the two folding members 30 are moved forward, parallel to path P1, ahead of group 2, so that sheet 5 of packing material is intercepted and folded partly into a U by folding members 30 (or rather, by folding members 30 inserted between contrasting members 31) before being intercepted by group 2 and the two lead-in devices 19. As shown in FIG. 14, group 2 and the two lead-in devices 19 then move through the two folding members 30 to intercept the already partly U-folded sheet 5 of packing material. At this point, contrasting member 31*a* is moved perpendicularly to path P1 (FIG. 15) to allow folding member 30*a* to keep moving, parallel to path P|, substantially into contact with transverse support 29 (FIG. 16).

Figure 17:
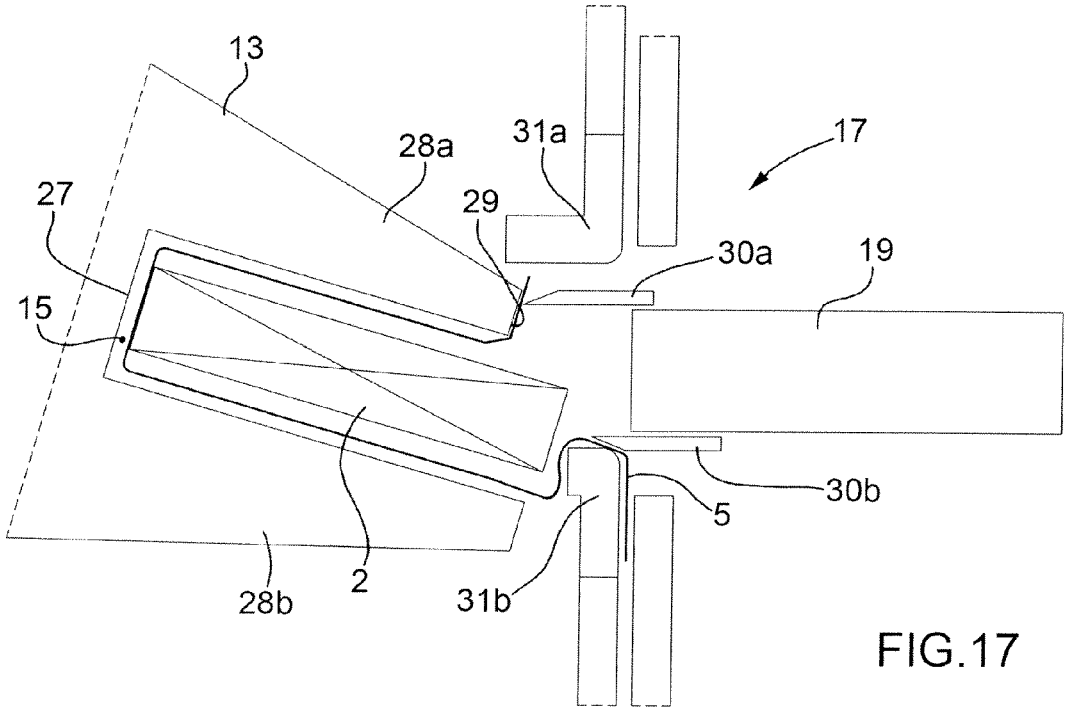
Figure 18:
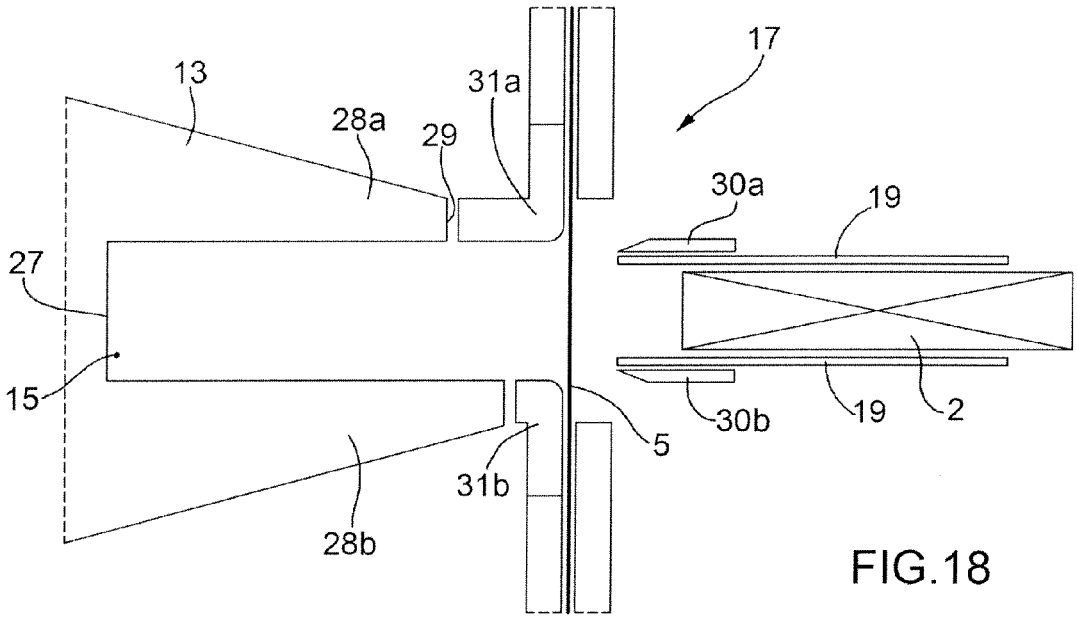
FIG. 18 shows a schematic side view, with parts removed for clarity, of a further embodiment of the feed station of the FIG. 7 packing unit.
Figure 19:
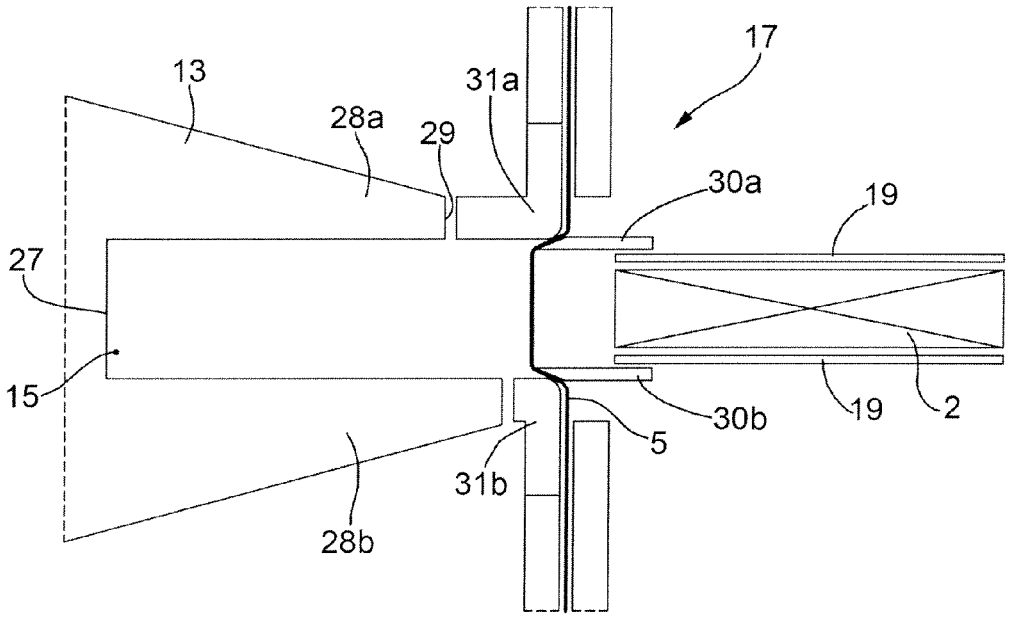
FIGS. 19-23 show schematic side views, with parts removed for clarity, of the FIG. 18 feed station folding a sheet of packing material about a group of cigarettes.
Figure 20:
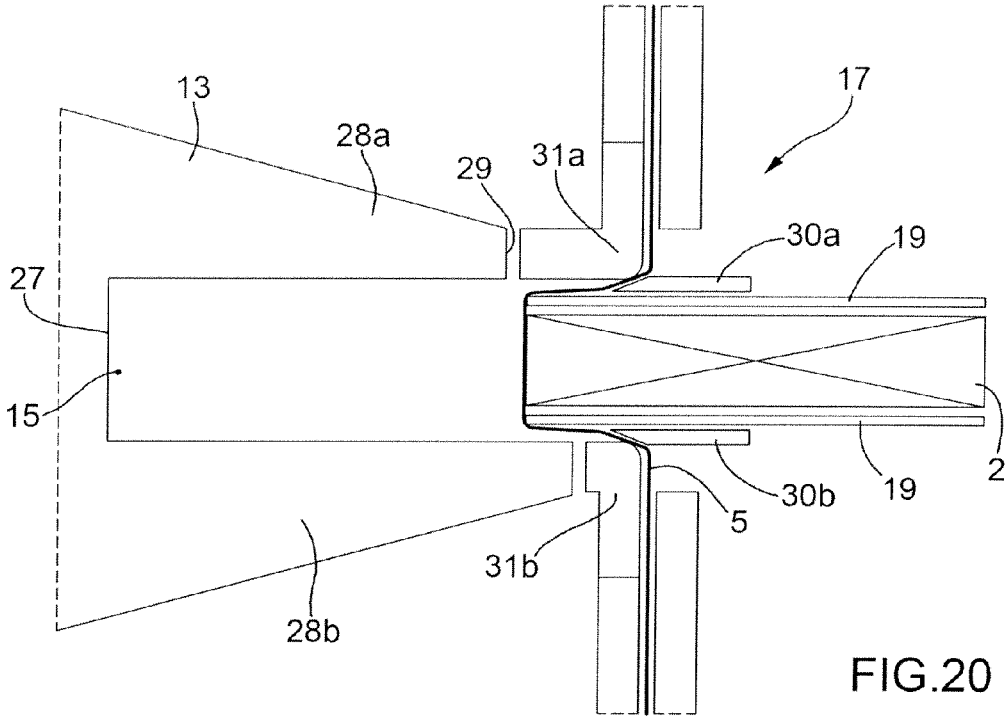
Figure 21:
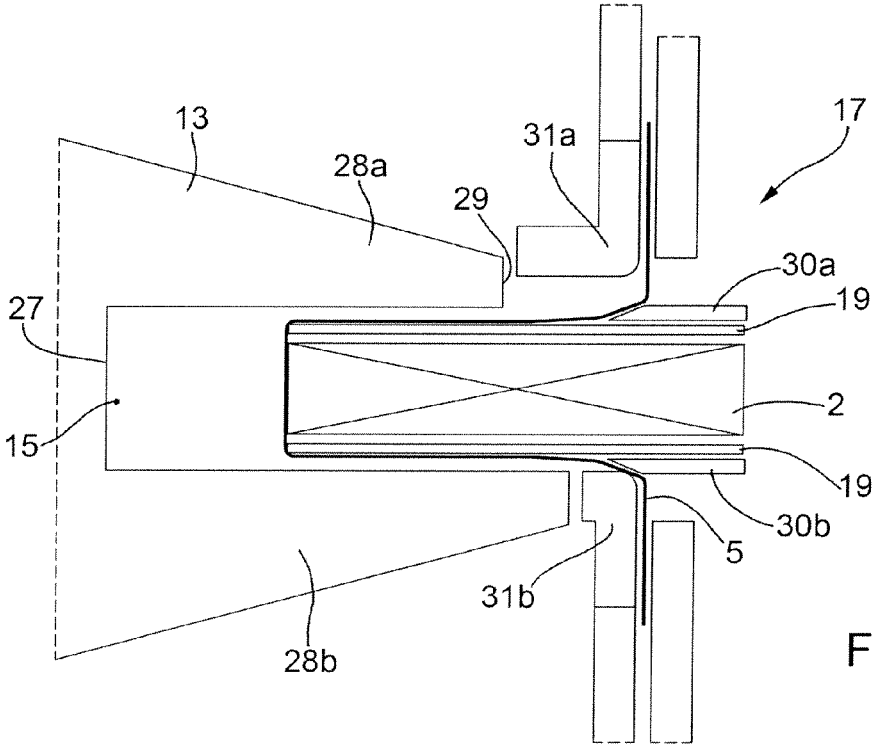
Figure 22:
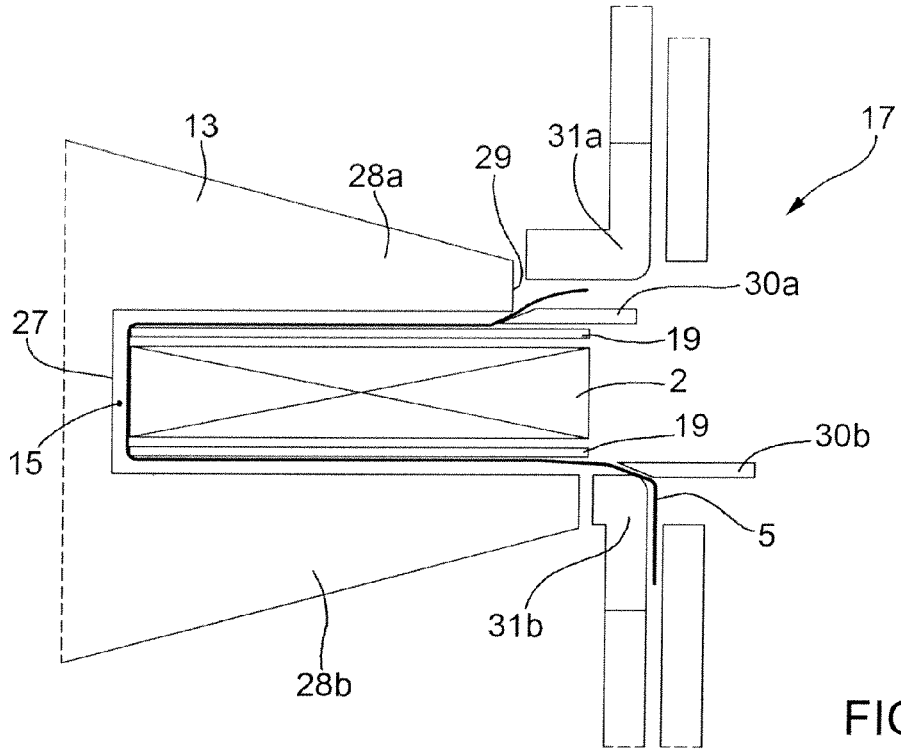
Figure 23:
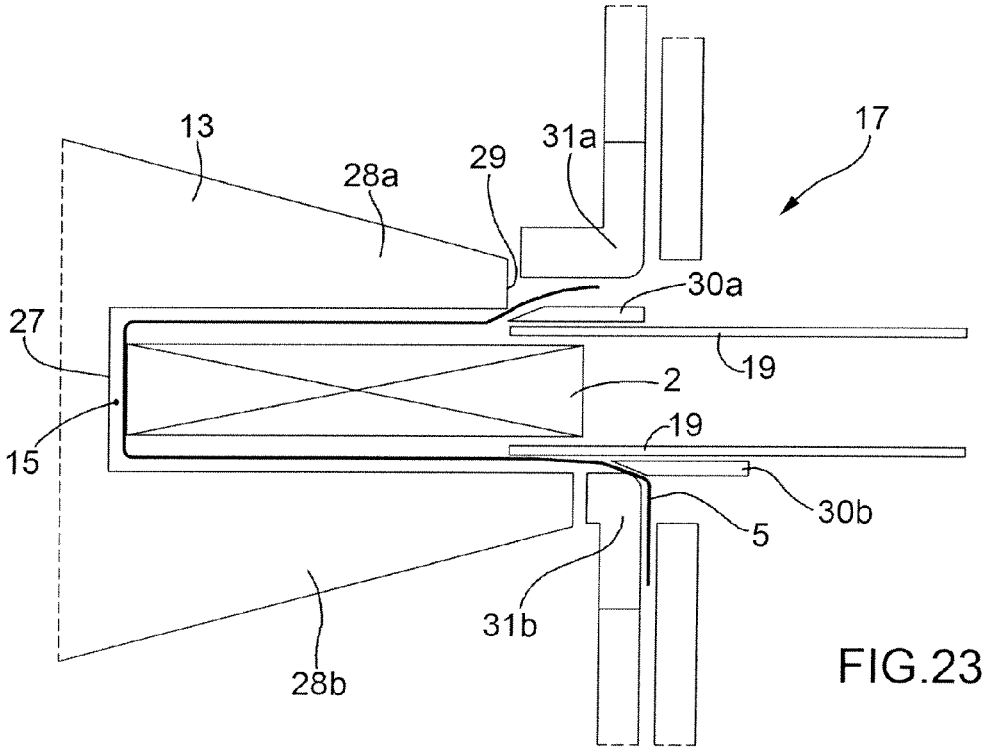

At this point, lead-in devices 19 start reversing, in the opposite direction to the travelling direction of group 2 (FIG. 16), when group 2 is only partly inserted inside pocket 15. Before lead-in devices 19 begin reversing, lateral retainers 25 are normally moved from the open to the closed position to retain group 2 laterally without interfering in any way with (i.e. without folding) sheet 5 of packing material. As shown in FIG. 17, rotation of packing wheel 13 (and therefore of pocket 15 on packing wheel 13) about axis of rotation 14 folds inner flap 10 perpendicularly to lateral wall 6*a* of group 2 and onto transverse support 29 with the aid of folding member 30*a*.

Finally, the two folding members 30 are also reversed, in the opposite direction to the travelling direction of group 2, back into the start position.

In the two embodiments in FIGS. 7-17, the two lead-in devices 19 are positioned contacting the minor lateral walls 7 of group 2, and are relatively thick (as shown in FIGS. 8-11) to permit suction through a front wall 21 of each lead-in device 19. In the FIG. 18-23 embodiment, on the other hand, the two lead-in devices 19 are positioned contacting the major lateral walls 6 of group 2, are thin (i.e. in the form of thin plates), and are interposed between sheet 5 of packing material and group 2 as sheet 5 of packing material is folded gradually into a U onto the two major lateral walls 6.

The folding steps in FIGS. 18-23 correspond to those in FIGS. 12-17.

In the FIG. 18-23 embodiment, the minor lateral walls 7 of group 2 are always clear, by not being engaged by lead-in devices 19, so lateral retainers 25 may be larger, parallel to path P1, than in the FIG. 7-17 embodiments.

In the FIG. 18-23 embodiment, lateral retainers 25 are inserted between lead-in devices 19, to prevent lateral retainers 25 from ever coming into contact with, and so folding, the lateral ends of sheet 5 of packing material. In other words, lead-in devices 19 keep the lateral ends of sheet 5 of packing material raised, to prevent the lateral ends from coming into contact with lateral retainers 25.

Finally, in the FIG. 18-23 embodiment, by not engaging minor lateral walls 7 of group 2 and so in no way hindering the movement of lateral retainers 25, lead-in devices 19 may be inserted inside pocket 15 to a point just short of end wall 27 of pocket 15 (obviously, with the interposition of sheet 5 of packing material); whereas, in the FIG. 7-17 embodiments, lead-in devices 19 must be stopped a good distance from end wall 27 of pocket 15, to avoid hindering the movement of lateral retainers 25. This difference can be seen clearly by comparing the position of lead-in devices 19 in FIGS. 16 and 22, which correspond to the same stage in the folding sequence.

In the FIG. 12-23 embodiments of packing unit 12, sheet 5 of packing material is first folded into a U solely by folding members 30 cooperating with contrasting members 31, i.e. solely by contoured metal members, so initial folding of sheet 5 of packing material into a U in no way stresses group 2 of cigarettes. When finish-folding sheet 5 of packing material into a U, the pressure exerted by sheet 5 of packing material is also distributed over lead-in devices 19, as opposed to solely on group 2. And finally, by virtue of the combined action of wedge-shaped folding members 30 inserted between funnel-shaped contrasting members 31 to pinch sheet 5 of packing material, the edges of sheet 5 of packing material at end wall 8*b* of group 2 are sharp and well defined, to impart an attractive square shape to this part of sheet 5.

The invention claimed is:

1. A packing method for folding a sheet (5) of packing material about a substantially parallelepiped-shaped article (2), the packing method comprising the steps of:

feeding the article (2) along a path (P1);

feeding the sheet (5) of packing material perpendicularly to the path (P1) and in front of the article (2), so the article (2), as it moves forward, intercepts and gradually folds the sheet (5) of packing material into a "U";

positioning two lead-in devices (19) on opposite sides of the article (2), so the article (2) is enclosed between the two lead-in devices (19);

feeding the two lead-in devices (19) parallel to the path (P1) and together with the article (2), so the sheet (5) of packing material is also intercepted by the lead-in devices (19);

positioning two folding members (30) on opposite sides of the path (P1) and spaced apart to allow the article (2), together with the lead-in devices (19), to pass between the two folding members (30);

feeding the two folding members (30) parallel to the path (P1) and ahead of the article (2), so the sheet (5) of packing material is intercepted and folded partly into a "U" by the folding members (30), before being intercepted by the article (2) together with the two lead-in devices (19);

feeding the article (2), together with the two lead-in devices (19), between the two folding members (30), so the article (2), together with the two lead-in devices (19), intercepts the partly U-folded sheet (5) of packing material;

positioning a pocket (15) of a packing conveyor (13) downstream from the sheet (5) of packing material in the travelling direction of the article (2); and inserting the article (2) and the sheet (5) of packing material, folded into a "U" about the article (2), into the pocket (15).

2. A packing method as claimed in claim 1, and comprising the further step of feeding the lead-in devices (19) forward with the same law of motion as the article (2), at least from the moment of impact with the sheet (5) of packing material.

3. A packing method as claimed in claim 1, and comprising the further step of feeding the lead-in devices (19) forward in line with a leading end wall (8*b*) of the article (2) facing the sheet (5) of packing material, at least from the moment of impact with the sheet (5) of packing material.

4. A packing method as claimed in claim 1, wherein:

the article (2) has two opposite, parallel major lateral walls (6); two opposite, parallel minor lateral walls (7); and two opposite, parallel end walls (8);

a leading end wall (8*b*) of the article (2) first impacts the sheet (5) of packing material, which folds gradually into a "U" onto the two major lateral walls (6); and the two lead-in devices (19) are positioned contacting the minor lateral walls (7) of the article (2).

5. A packing method as claimed in claim 4, and comprising the further step of activating suction through a front wall (21), facing the sheet (5) of packing material, of each lead-in device (19), prior to impact with the sheet (5) of packing material.

6. A packing method as claimed in claim 5, and comprising the further step of cutting off suction through the front wall (21), facing the sheet (5) of packing material, of each lead-in device (19), just before reversing the lead-in devices (19) in the opposite direction to the travelling direction of the article (2).

7. A packing method as claimed in claim 1, wherein:

the article (2) has two opposite, parallel major lateral walls (6); two opposite, parallel minor lateral walls (7); and two opposite, parallel end walls (8);

a leading end wall (8*b*) of the article (2) first impacts the sheet (5) of packing material, which folds gradually into a "U" onto the two major lateral walls (6); and the two lead-in devices (19) are positioned contacting the major lateral walls (6) of the article (2), are thin, and are interposed between the sheet (5) of packing material and the article (2) as the sheet (5) of packing material folds gradually into a "U" onto the two major lateral walls (6).

8. A packing method as claimed in claim 1, wherein:

the article (2) has two opposite, parallel major lateral walls (6); two opposite, parallel minor lateral walls (7); and two opposite, parallel end walls (8);

a leading end wall (8*b*) of the article (2) first impacts the sheet (5) of packing material, which folds gradually into a "U" onto the two major lateral walls (6); and the two folding members (30) are positioned parallel to and facing the major lateral walls (6) of the article (2).

9. A packing method as claimed in 1, and comprising the further step of pinching the sheet (5) of packing material between each folding member (30) and a corresponding fixed contrasting member (31) cooperating with the folding member (30).

10. A packing method as claimed in claim 9, wherein each folding member (30) is wedge-shaped at the front, and each contrasting member (31) is funnel-shaped to negatively reproduce the wedge shape of the folding member (30).

11. A packing method as claimed in claim 1, and comprising the further steps of:

feeding the sheet (5) of packing material asymmetrically in front of the article (2), so the sheet (5) of packing material has an outer flap (9) projecting from the pocket (15), and an inner flap (10) resting on a lateral wall (6*a*) of the article (2)); and folding the inner flap (10) perpendicularly to the lateral wall (6*a*) of the article (2) by means of a corresponding first folding member (30*a*), which is fed forward, parallel to the path (P1), after the article (2), together with the two lead-in devices (19), intercepts the sheet (5) of packing material.

12. A packing method as claimed in claim 11, and comprising the further steps of:

pinching the sheet (5) of packing material between each folding member (30) and a corresponding fixed contrasting member (31) cooperating with the folding member (30); and moving a first contrasting member (31*a*), associated with the first folding member (30*a*), to allow the first folding member (30*a*) to move forward.

13. A packing method as claimed in claim 1, and comprising the further step of reversing the lead-in devices (19), in the opposite direction to the travelling direction of the article (2), when the article (2) is at least partly inserted inside the pocket (15).

14. A packing method as claimed in claim 1, and comprising the further step of reversing the lead-in devices (19), in the opposite direction to the travelling direction of the article (2), before the article (2) is inserted inside the pocket (15).

15. A packing method as claimed in claim 1, and comprising the further step of providing the pocket (15) with two fixed lateral retainers (25) for laterally engaging the article (2) inside the pocket (15).

16. A packing method as claimed in claim 1, and comprising the further steps of:

providing the pocket (15) with two lateral retainers (25) movable, crosswise to the pocket (15), between a closed position, in which the lateral retainers (25) engage the article (2) laterally inside the pocket (15), and an open position, in which the lateral retainers (25) are detached from the article (2) inside the pocket (15);

moving the lateral retainers (25) into the open position as the article (2) is inserted into the pocket (15); and moving the lateral retainers (25) into the closed position when the article (2) is at least partly inserted inside the pocket (15).

17. A packing method as claimed in claim 16, and comprising the further step of moving the lateral retainers (25) into the closed position when the article (2) is partly engaged by the lead-in devices (19), so that, at least for an instant, the article (2) is engaged by both the lateral retainers (25) and the lead-in devices (19).

18. A packing method as claimed in claim 1, wherein the article (2) is a group of cigarettes.

* * * * *